US009022743B2

(12) United States Patent
Dierberger

(10) Patent No.: US 9,022,743 B2
(45) Date of Patent: May 5, 2015

(54) SEGMENTED THERMALLY INSULATING COATING

(75) Inventor: James A. Dierberger, Hebron, CT (US)

(73) Assignee: United Technologies Corporation, Hartford, CT (US)

( * ) Notice: Subject to any disclaimer, the term of this patent is extended or adjusted under 35 U.S.C. 154(b) by 730 days.

(21) Appl. No.: 13/307,295

(22) Filed: Nov. 30, 2011

(65) Prior Publication Data

US 2013/0136584 A1 May 30, 2013

(51) Int. Cl.
*F01D 25/08* (2006.01)
*F01D 25/14* (2006.01)
*C23C 4/00* (2006.01)

(52) U.S. Cl.
CPC ..... *F01D 25/08* (2013.01); *F01D 25/145* (2013.01); *C23C 4/00* (2013.01)

(58) Field of Classification Search
None
See application file for complete search history.

(56) References Cited

U.S. PATENT DOCUMENTS

| | | | | |
|---|---|---|---|---|
| 4,273,824 | A | 6/1981 | McComas et al. | |
| 4,639,388 | A | 1/1987 | Ainsworth et al. | |
| 4,914,794 | A | 4/1990 | Strangman | |
| 5,057,379 | A | 10/1991 | Fayeulle et al. | |
| 5,064,727 | A | 11/1991 | Naik et al. | |
| 5,419,971 | A | 5/1995 | Skelly et al. | |
| 5,558,922 | A * | 9/1996 | Gupta et al. | 428/141 |
| 5,609,921 | A | 3/1997 | Gitzhofer et al. | |
| 5,705,231 | A | 1/1998 | Nissley et al. | |
| 6,102,656 | A | 8/2000 | Nissley et al. | |
| 6,251,526 | B1 | 6/2001 | Staub | |
| 6,358,002 | B1 | 3/2002 | Good et al. | |
| 6,447,854 | B1 * | 9/2002 | Rigney et al. | 427/596 |
| 6,846,574 | B2 | 1/2005 | Subramanian | |
| 6,884,384 | B2 | 4/2005 | Merrill et al. | |
| 7,112,758 | B2 | 9/2006 | Ma et al. | |
| 7,563,503 | B2 | 7/2009 | Gell et al. | |
| 8,240,675 | B2 * | 8/2012 | Hirakawa et al. | 277/412 |
| 8,506,243 | B2 * | 8/2013 | Strock et al. | 415/173.1 |
| 2001/0004436 | A1 | 6/2001 | Chasripoor | |
| 2002/0009609 | A1 * | 1/2002 | Ritter et al. | 428/608 |
| 2006/0222777 | A1 | 10/2006 | Skoog et al. | |
| 2007/0224443 | A1 * | 9/2007 | Torigoe et al. | 428/632 |

(Continued)

FOREIGN PATENT DOCUMENTS

| | | |
|---|---|---|
| EP | 2233803 | 9/2010 |
| GB | 2272453 | 5/1994 |

OTHER PUBLICATIONS

Trice, et al.: "Column Formation in Suspension Plasma-Sprayed Coatings and Resultant Thermal Properties," Journal of Thermal Spray Technology, ASM International, 42 pp.

(Continued)

*Primary Examiner* — Edward Look
*Assistant Examiner* — Christopher R Legendre
(74) *Attorney, Agent, or Firm* — Carlson, Gaskey & Olds, P.C.

(57) ABSTRACT

A gas turbine article includes a substrate and a thermally insulating topcoat disposed on a surface of the substrate. The surface of the substrate includes a surface pattern defining first surface regions and second surface regions. The first surface regions include incubation sites that are favorable for deposition of the thermally insulating topcoat and the second surface regions are less favorable for deposition of the topcoat. The topcoat includes segmented portions that are separated by faults extending through the topcoat from the second regions.

21 Claims, 2 Drawing Sheets

(56) References Cited

U.S. PATENT DOCUMENTS

| | | | | |
|---|---|---|---|---|
| 2009/0280298 | A1 | 11/2009 | Rosenzweig et al. | |
| 2011/0151219 | A1 | 6/2011 | Nagaraj et al. | |
| 2011/0164981 | A1* | 7/2011 | Hardwicke | 416/179 |
| 2013/0136584 | A1* | 5/2013 | Dierberger | 415/177 |

OTHER PUBLICATIONS

U.S. Appl. No. 12/621,557, filed Nov. 19, 2009 Entitled "Segmented Thermally Insulating Coating".
Search Report and Written Opinion Mailed on Feb. 11, 2011.

* cited by examiner

SEGMENTED THERMALLY INSULATING COATING

BACKGROUND

Components that are exposed to high temperatures, such as turbine engine hardware, typically include protective coatings. For example, components such as turbine blades, turbine vanes, blade outer air seals, combustor liners and compressor components typically include one or more coating layers that serve to protect the component from erosion, oxidation, corrosion or the like and thereby enhance component durability and maintain efficient engine operation.

Internal stresses can develop in the protective coating over time with continued exposure to high temperature environments in an engine. The internal stresses can lead to erosion, spalling and loss of the coating. The component is then replaced or refurbished.

SUMMARY

Disclosed is a turbine engine article that includes a substrate and a thermally insulating topcoat on a surface of the substrate. The surface of the substrate includes a surface pattern that defines first surface regions and second surface regions. The first surface regions include incubation sites that are favorable for deposition of the thermally insulating topcoat and the second surface regions are less favorable for deposition of the thermally insulating topcoat. The thermally insulating topcoat includes segmented portions that are separated by faults extending through the thermally insulating topcoat from the second regions.

Also disclosed is a method of fabricating a turbine engine article. The method includes providing a substrate that has a surface pattern defining first surface regions and second surface regions. The first surface regions include incubation sites that are favorable for deposition of a thermally insulating topcoat and the second surface regions are less favorable for deposition of the thermally insulating topcoat. The thermally insulating topcoat is deposited onto the surface pattern such that the thermally insulating topcoat forms with faults that extend through the topcoat from the second regions to separate segmented portions of the topcoat.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
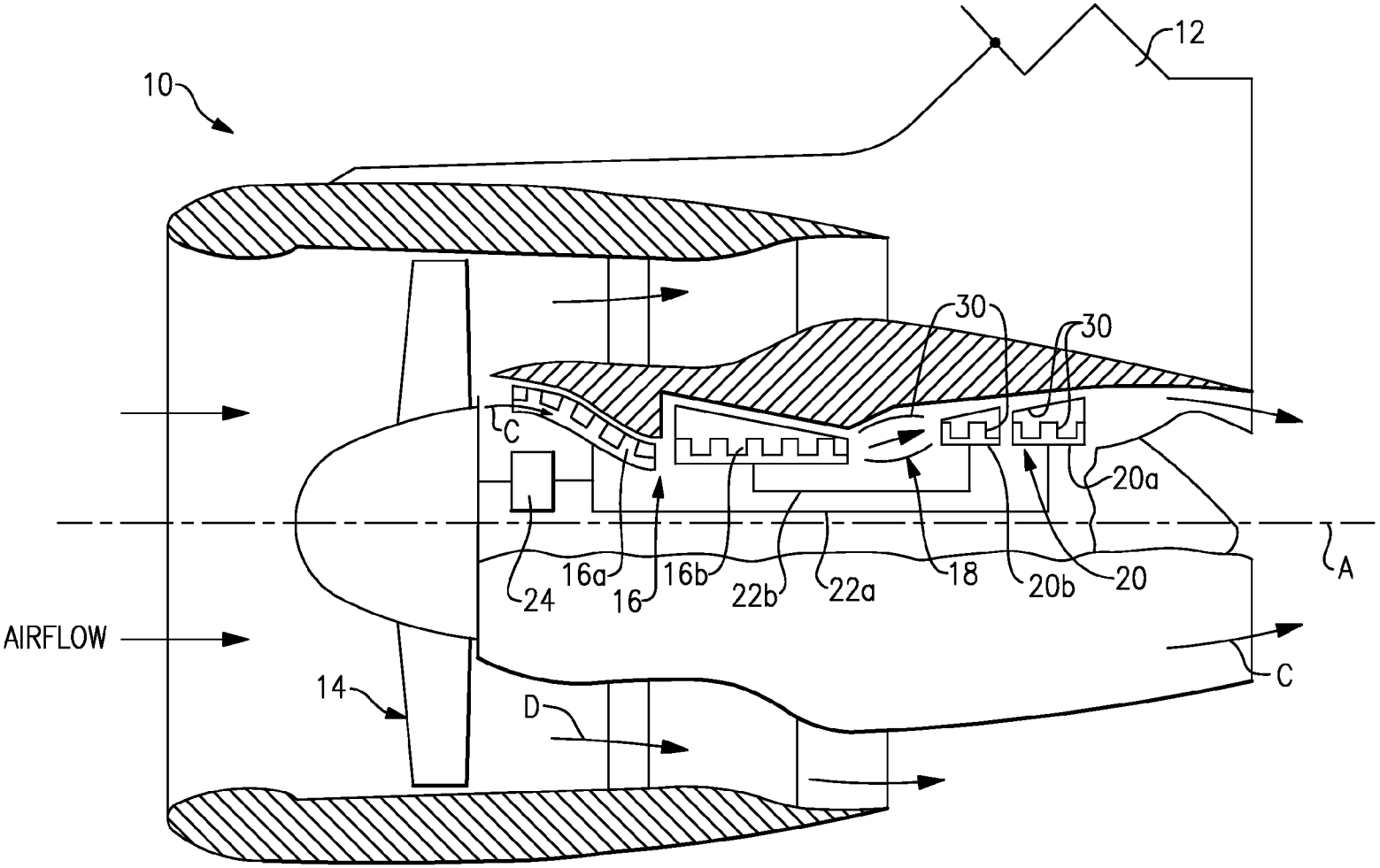
FIG. 1 illustrates an example turbine engine.
Figure 2:
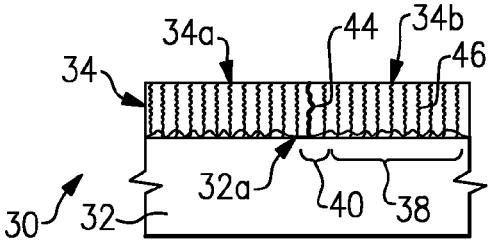
FIG. 2 illustrates a portion of an example turbine engine component.

FIG. 1 illustrates a schematic view of selected portions of an example turbine engine 10, which serves as an exemplary operating environment for a turbine engine component 30 (FIG. 2). As will be described in further detail, the turbine engine component 30 includes a thermally insulating topcoat 34 that has pre-existing locations for releasing energy associated with internal stresses that are caused by exposure to elevated temperatures.

In the illustrated example, the turbine engine 10 is suspended from an engine pylon 12 of an aircraft, as is typical of an aircraft designed for subsonic operation. The turbine engine 10 is circumferentially disposed about an engine centerline, or axial centerline axis A. The turbine engine 10 includes a fan 14, a compressor 16 having a low pressure compressor section 16*a* and a high pressure compressor section 16*b*, a combustion section 18, and a turbine 20 having a high pressure turbine section 20*b* and a low pressure turbine section 20*a*.

As is known, air compressed in the compressors 16*a*, 16*b* is mixed with fuel that is burned in the combustion section 18 and expanded in the turbines 20*a* and 20*b*. The turbines 20*a* and 20*b* are coupled to drive, respectively, rotors 22*a* and 22*b* (e.g., spools) to rotationally drive the compressors 16*a*, 16*b* and the fan 14 in response to the expansion. In this example, the rotor 22*a* drives the fan 14 through a gear train 24.

In the example shown, the turbine engine 10 is a high bypass, geared turbofan arrangement, although the examples herein can also be applied in other engine configurations. In one example, the bypass ratio of bypass airflow (D) to core airflow (C) is greater than 10:1, the fan 14 diameter is substantially larger than the diameter of the low pressure compressor 16*a* and the low pressure turbine 20*a* has a pressure ratio that is greater than 5:1. The gear train 24 can be any known suitable gear system, such as a planetary gear system with orbiting planet gears, planetary system with non-orbiting planet gears, or other type of gear system. In the disclosed example, the gear train 24 has a constant gear ratio. It is to be appreciated that the illustrated engine configuration and parameters are only exemplary and that the examples disclosed herein are applicable to other turbine engine configurations, including ground-based turbines that do not have fans.

As can be appreciated, the low pressure compressor section 16*a*, the high pressure compressor section 16*b*, the high pressure turbine section 20*b*, the low pressure turbine section 20*a* and the combustor 18 include turbine engine components, generally designated as components 30, that are subjected to relatively high temperatures during engine operation. The components 30 include one or more of rotatable blades, stationary vanes, outer air seals, combustors and liners, heat shields, exhaust cases and turbine frames, as well as any component that utilizes a thermal barrier coating, for example.

FIG. 2 shows a portion of one of the components 30. The component 30 includes a substrate 32 and a thermally insulating topcoat 34 disposed on a surface 32*a* of the substrate 32. As shown in isolated views of the substrate 32 in FIGS. 3A and 3B, the surface 32*a* includes a surface pattern 36 with regard to first surface regions 38 and second surface regions 40. The surface regions 38 and 40 are distinguished by their favorability for deposition of the thermally insulating topcoat 34. The first surface regions 38 include incubation sites 42 that are favorable for deposition of the thermally insulating topcoat 34. The second surface regions 40 do not have incubation sites, have fewer incubation sites per unit of area than the first surface regions 38 or have incubation sites that are less favorable for deposition than the incubation sites 42 of the first surface regions 38. The second surface regions 40 are thus less favorable for deposition of the thermally insulating topcoat 34 relative to the first surface regions 38.

In one embodiment, the first surface regions 38 have a first surface roughness and the second surface regions 40 have a second surface roughness that is less than the first surface roughness. The first surface roughness and the second surface roughness are defined by the parameter $R_a$, for example. In one example, the surface roughness is provided by masking off the areas of the second surface regions 40 and peening the remaining areas of the first surface regions 38 to a predetermined roughness. In another example, the surface roughness is provided by grit blasting the entire surface of the substrate 32, masking off the areas of the first surface regions 38 and chemically milling the remaining areas to form the second surface regions 40 to smooth the roughness created by the milling. Alternatively, the roughness is provided during formation of the substrate 32, in a casting process, for example. In other alternatives, the roughness is provided by laser or chemical etching, or selectively depositing fine grit particles on the areas of the first surface regions 38. The fine grit particles are of the same or similar composition as the substrate 32 and/or thermally insulating topcoat 34.

The relative roughness of the first surface regions 38 versus the roughness of the second surface regions 40 serves as the incubation sites 42 that are favorable for deposition of the thermally insulating topcoat 34. For example, the roughness defines random peaks and valleys in the first surface regions 38. The peaks and valleys provide surface discontinuities that are favorable for the deposition of the thermally insulating topcoat 34. In one embodiment, the surface discontinuities have a maximum dimension of 5 to 10 micrometers with regard to an average distance between the peaks and valleys. If fine grit particles are used, the particles are 5 to 10 micrometers in average diameter. In further examples, the maximum dimension (e.g., height) of the surface discontinuities is less than 100 micrometers. In a further alternative, the maximum dimension of the surface discontinuities is less than 25 micrometers.

The thermally insulating topcoat 34 includes segmented portions 34*a* and 34*b* that are separated by faults 44 (one shown) that extend through the thermally insulating topcoat 34 from the second region 40. It is to be understood that the component 30 includes multiple segmented portions separated by multiple faults 44. The faults 44 facilitate reducing internal stresses within the thermally insulating topcoat 34 that may occur from sintering of the topcoat material at relatively high surface temperatures within the turbine engine 10 during operation.

Depending on the location in the turbine engine 10, the thermally insulating topcoat 34 can be exposed to temperatures of 2500° F. (1370° C.) or higher, which may cause sintering of the thermally insulating topcoat 34. The sintering may result in partial melting, densification, and diffusional shrinkage of the thermally insulating topcoat 34 and thereby induce internal stresses. The faults 44 provide pre-existing locations for releasing energy associated with the internal stresses (e.g., reducing shear and radial stresses). That is, the energy associated with the internal stresses may be dissipated in the faults 44 such that there is less energy available for causing delamination cracking between the thermally insulating topcoat 34 and the underlying substrate 32. The faults 44 may also serve as expansion gaps for thermal expansion of the topcoat 34.

The structure of the faults 44 can vary depending upon the process used to deposit the thermally insulating topcoat 34 and the surface pattern 36, for instance. In one example, the faults 44 are gaps between neighboring segmented portions 34*a* and 34*b*. Alternatively, or in addition to gaps, the faults 44 are microstructural discontinuities between neighboring segmented portions 34*a* and 34*b*. For instance, the segmented portions 34*a* and 34*b* have a columnar grain microstructure 46 and the faults 44 are microstructural discontinuities between neighboring clusters or "cells" of grains. Thus, the faults 44 may be considered to be planes of weakness in the thermally insulating topcoat 34 such that the segmented portions 34*a* and 34*b* can thermally expand and contract without producing a significant amount of stress from restriction of a neighboring segmented portion 34*a* or 34*b* and/or any cracking that does occur in the thermally insulating topcoat 34 from internal stresses is dissipated through propagation of the crack along the faults 44. Thus, the faults 44 facilitate dissipation of internal stress energy within the thermally insulating topcoat 34.

Figure 3A:
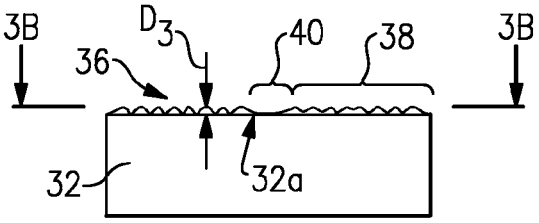
FIG. 3A illustrates an isolated view of an example substrate of a turbine engine component.
Figure 3B:
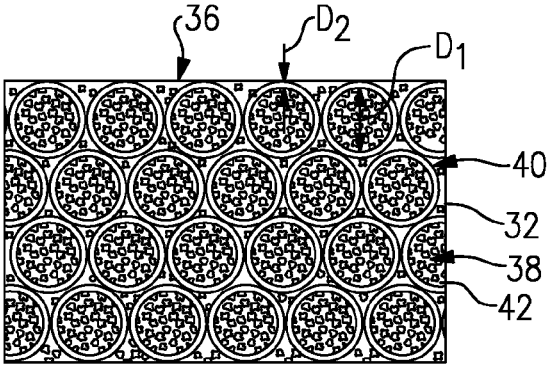
FIG. 3B illustrates another isolated view of the substrate of FIG. 3A.

Referring to FIGS. 3A and 3B, the surface pattern 36 in this example is a grid that includes the second surface regions 40 arranged as interconnected borders that circumscribe the first surface regions 38. The grid is thus a cellular pattern. As shown, the interconnected borders form circular cells that induce approximately circular or approximately hexagonal shapes of the segmented portions 34*a* and 34*b* of the thermally insulating topcoat 34. As can be appreciated, interconnected border geometries can be provided to form other geometrically-shaped cells, combinations of different geometrically-shaped cells, non-geometric cells, non-cellular shapes or complex shapes or patterns.

The geometry of the grid with regard to shape and dimensions of the surface pattern 36 controls the deposition of the thermally insulating topcoat 34 and formation of the faults 44. For example, each of the first surface regions 38 defines a maximum dimension ($D_1$) and the borders define a minimum dimension ($D_2$) of the second surface regions 40. The dimensions $D_1$ and $D_2$ are predefined to provide a desired fault density and degree of thermal protection. For example, if dimension $D_2$ is too large relative to dimension $D_1$, the faults 44 form as relatively large gaps in the thermally insulating topcoat 34 and debit thermal protection. On the other hand, if dimension $D_2$ is too small relative to dimension $D_1$, the thermally insulating topcoat 34 can bridge over or onto the second surface regions 40 and thus avoid proper formation of the faults 44. Thus, a predetermined ratio of $D_1/D_2$ ($D_1$ divided by $D_2$) is selected to provide a balance of thermal protection and fault formation. In one example, the ratio is from 6 to 50. In a further example, the ratio is from 7.5 to 25.

In a further example, the geometry of the incubation sites 42 with regard to dimensions is also controlled. In one embodiment, the incubation sites 42, such as the surface discontinuities, have a maximum dimension of $D_3$, and $D_2$ is greater than $D_3$. Controlling $D_2$ to be greater than $D_3$ ensures that the second surface regions 40 are discernible from the first surface regions 38 to form the segmented portions 34*a* and 34*b*.

In a further embodiment, the selected maximum dimension ($D_1$) of the first surface regions 38 is smaller than a spacing of cracks that would occur naturally, without the faults 44, which makes the thermally insulating topcoat 34 more resistant to spalling and delamination.

In the illustrated example, the substrate 32 optionally includes a metallic alloy, a metallic bond coat or both. In embodiments, the metallic alloy is a superalloy material, such as a nickel-based or cobalt-based alloy. For example, the topcoat 34 is deposited directly on to the superalloy substrate. In another embodiment, the superalloy includes a bond coat thereon to enhance bonding with the topcoat 34. In some embodiments, the bond coat includes a nickel alloy, platinum, gold, silver, or MCrAlY where the M includes at least one of nickel, cobalt, iron, or combination thereof, Cr is chromium, Al is aluminum and Y is yttrium.

In the disclosed example, the thermally insulating topcoat 34 is a ceramic material that is selected to provide a desired thermal resistance for the given end use application. As an example, the thermally insulating topcoat 34 is or includes yttria stabilized zirconia, hafnia, gadolinia, gadolinia zirconate, molybdate, alumina or combinations thereof and can be graded or ungraded. Given this description, one of ordinary skill in the art will recognize other types of ceramic materials to meet their particular needs.

The faults 44 form during the deposition of the thermally insulating topcoat 34. In one example, the deposition process includes a thermal spray technique. One example thermal spray technique that is capable of producing the desired columnar grain microstructure 46 is a suspension or solution plasma spray process in which particles of the coating material are suspended in a mixture with a liquid or semi-liquid carrier. The mixture is sprayed into a plasma discharge that volatilizes the carrier and melts or partially melts the coating material. The melted or partially melted coating material then kinetically deposits onto the first surface regions 38 of the surface pattern 36 of the substrate 32.

Figure 4:
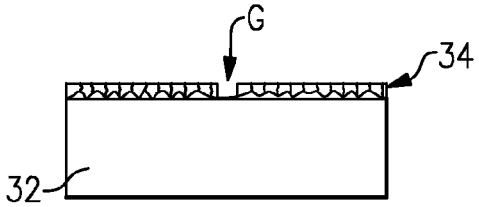
FIG. 4 illustrates an example turbine engine component at an intermediate stage of depositing a topcoat.

As shown in FIG. 3A, the substrate 32 with the surface pattern 36 is initially provided in the deposition process. The deposition process then gradually deposits the thermally insulating topcoat 34, as shown in the intermediate stage of the process in FIG. 4. As the thermally insulating topcoat 34 initially deposits onto the surface pattern 36, the coating material preferentially deposits at the incubation sites 42 rather than the second surface regions 40 that are less favorable for initial deposition. Thus, there are initially gaps G over the second surface regions between coating "cells." Depending on the selected geometry of the surface pattern 36 and particular deposition process and process parameters, the gap G may remain in the final thermally insulating topcoat 34 or the coating material may partially bridge over the gap G to form a microstructural discontinuity.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A turbine engine comprising:

a compressor section;

a combustor fluidly connected with the compressor section; and a turbine section downstream from the combustor, and at least one of the compressor section, the combustor and the turbine section includes a substrate and a thermally insulating topcoat disposed on a surface of the substrate, the surface of the substrate including a surface pattern defining first surface regions and second surface regions, the first surface regions including incubation sites that are favorable for deposition of the thermally insulating topcoat and the second surface regions are less favorable for deposition of the thermally insulating topcoat relative to the first surface regions, and the thermally insulating topcoat includes segmented portions that are separated by faults extending through the thermally insulating topcoat from the second surface regions, wherein the first surface regions have a first surface roughness and the second surface regions have a second surface roughness that is less than the first surface roughness.

2. A turbine engine article comprising:

a substrate; and a thermally insulating topcoat disposed on a surface of the substrate, the surface of the substrate including a surface pattern defining first surface regions and second surface regions, the first surface incubation sites that are favorable for deposition of the thermally insulating topcoat and the second surface regions are less favorable for deposition of the thermally insulating topcoat relative to the first surface regions, and the thermally insulating topcoat includes segmented portions that are separated by faults extending through the thermally insulating topcoat from the second surface regions, wherein the surface pattern comprises a grid with the second surface regions arranged as borders that circumscribe cells of the first surface regions and each of the cells defines a maximum dimension ($D_1$) and the borders define a minimum dimension ($D_2$) of the second surface regions such that a ratio of $D_1/D_2$ ($D_1$ divided by $D_2$) is from 6 to 50.

3. The turbine engine article as recited in claim 2, wherein the ratio is from 7.5 to 25.

4. The turbine engine article as recited in claim 2, wherein the incubation sites comprise surface discontinuities having a maximum dimension ($D_3$), and $D_2$ is greater than $D_3$.

5. A turbine engine article comprising:

a substrate; and a thermally insulating topcoat disposed on a surface of the substrate, the surface of the substrate including a surface pattern defining first surface regions and second surface regions, the first surface regions including incubation sites that are favorable for deposition of the thermally insulating topcoat and the second surface regions are less favorable for deposition of the thermally insulating topcoat relative to the first surface regions, the incubation sites including random surface peaks and valleys defining surface discontinuities having a maximum dimension of $D_3$, the second surface regions defining a minimum dimension $D_2$, that is greater than $D_3$, and the thermally insulating topcoat includes segmented portions that are separated by faults extending through the thermally insulating topcoat from the second surface regions.

6. The turbine engine article as recited in claim 5, wherein the surface pattern comprises a grid with the second surface regions arranged as borders that circumscribe cells of the first surface regions.

7. The turbine engine article as recited in claim 5, wherein the thermally insulating topcoat comprises a ceramic material that has a columnar grain microstructure.

8. The turbine engine article as recited in claim 5, wherein the surface pattern is geometric.

9. The turbine engine article as recited in claim 5, wherein the incubation sites comprise surface discontinuities having a maximum dimension of 1 to 25 micrometers.

10. The turbine engine article as recited in claim 5, wherein the incubation sites comprise surface discontinuities having a maximum dimension that is less than 100 micrometers.

11. The turbine engine article as recited in claim 5, wherein the incubation sites comprise surface discontinuities having a maximum dimension of 5 to 10 micrometers with regard to an average distance between peaks and valleys of the surface discontinuities.

12. The turbine engine article as recited in claim 5, wherein the faults are gaps between the segmented portions.

13. The turbine engine article as recited in claim 5, wherein the faults are microstructural discontinuities between the segmented portions.

14. The turbine engine article as recited in claim 5, wherein the surface pattern is a surface roughness pattern.

15. A turbine engine article comprising:

a substrate; and a thermally insulating topcoat disposed on a surface of the substrate, the surface of the substrate including a surface pattern defining first surface regions and second surface regions, the first surface regions including incubation sites that are favorable for deposition of the thermally insulating topcoat and the second surface regions are less favorable for deposition of the thermally insulating topcoat relative to the first surface regions, and the thermally insulating topcoat includes segmented portions that are separated by faults extending through the thermally insulating topcoat from the second surface regions, wherein the first surface regions have a first surface roughness and the second surface regions have a second surface roughness that is less than the first surface roughness.

16. A method of fabricating a turbine engine article, comprising:

providing a substrate that includes a surface pattern defining first surface regions and second surface regions, the first surface regions including incubation sites that are favorable for deposition of a thermally insulating topcoat and the second surface regions are less favorable for deposition of the thermally insulating topcoat relative to the first surface regions, including establishing the surface pattern to include a grid with the second surface regions arranged as borders that circumscribe cells of the first surface regions, wherein each of the cells defines a maximum dimension ($D_1$) and the borders define a minimum dimension ($D_2$) of the second surface regions, and establishing a ratio of $D_1/D_2$ ($D_1$ divided by $D_2$) that is from 6 to 50; and depositing the thermally insulating topcoat onto the surface pattern such that the thermally insulating topcoat forms with faults that extend through the thermally insulating topcoat from the second surface regions to separate segmented portions of the thermally insulating topcoat.

17. A method of fabricating a turbine engine article, comprising:

providing a substrate that includes a surface pattern defining first surface regions and second surface regions, the first surface regions including incubation sites that are favorable for deposition of a thermally insulating topcoat and the second surface regions are less favorable for deposition of the thermally insulating topcoat relative to the first surface regions, the incubation sites including random surface peaks and valleys defining surface discontinuities having a maximum dimension of $D_3$, the second surface regions defining a minimum dimension $D_2$ that is greater than $D_3$; and depositing the thermally insulating topcoat onto the surface pattern such that the thermally insulating topcoat forms with faults that extend through the thermally insulating topcoat from the second surface regions to separate segmented portions of the thermally insulating topcoat.

18. The method as recited in claim 17, including depositing the thermally insulating topcoat using a thermal spray deposition process.

19. The method as recited in claim 17, including depositing the thermally insulating topcoat using a suspension plasma spray process.

20. The method as recited in claim 17, including establishing the surface pattern to include a grid with the second surface regions arranged as borders that circumscribe cells of the first surface regions.

21. A method of fabricating a turbine engine article, comprising:

providing a substrate that includes a surface pattern defining first surface regions a second surface regions, the first surface regions including incubation sites that are favorable for deposition of a thermally insulating topcoat and the second surface regions are less favorable for deposition of the thermally insulating topcoat relative to the first surface regions, including establishing the first surface regions to have a first surface roughness and the second surface regions to have a second surface roughness that is less than the first surface roughness; and depositing the thermally insulating topcoat onto the surface pattern such that the thermally insulating topcoat forms with faults that extend through the thermally insulating topcoat from the second surface regions to separate segmented portions of the thermally insulating topcoat.

* * * * *